US005233361A

United States Patent [19]

Boguais

[11] Patent Number: 5,233,361

[45] Date of Patent: Aug. 3, 1993

[54] PLANAR HIGH-FREQUENCY AERIAL FOR CIRCULAR POLARIZATION

[75] Inventor: Marc Boguais, Saint-Cloud, France

[73] Assignee: U.S. Philips Corporation, New York, N.Y.

[21] Appl. No.: 908,642

[22] Filed: Jul. 2, 1992

Related U.S. Application Data

[63] Continuation of Ser. No. 839,021, Feb. 18, 1992, abandoned, which is a continuation of Ser. No. 581,501, Sep. 11, 1990, abandoned.

[30] Foreign Application Priority Data

Sep. 19, 1989 [FR] France ..... 89 12264

[51] Int. Cl.[5] ..... H01Q 1/38

[52] U.S. Cl. ..... 343/700 MS; 343/853

[58] Field of Search ..... 343/700 MS, 777, 853, 343/852, 893, 844, 850

[56] References Cited

U.S. PATENT DOCUMENTS

| | | | |
|---|---|---|---|
| 4,761,653 | 8/1988 | Owens et al. | 343/700 MS |
| 4,816,835 | 3/1989 | Abiko et al. | 343/700 MS |
| 4,914,445 | 4/1990 | Shoemaker | 343/853 |
| 4,937,585 | 6/1990 | Shoemaker | 343/700 MS |
| 5,001,493 | 3/1991 | Patin et al. | 343/700 MS |

*Primary Examiner*—Rolf Hille
*Assistant Examiner*—Hoanganh Le
*Attorney, Agent, or Firm*—Robert J. Kraus

[57] ABSTRACT

A planar aerial comprising a plurality of radiating plates (PR) connected by lines (LV, LH, LSV, LSH) having sufficient lengths for summing the signals at two points (H, V). On line H D G V the signal having a clockwise circularly polarised wave is present at D, and the signal having a counterclockwise circularly polarised wave is present at G.

6 Claims, 7 Drawing Sheets

PLANAR HIGH-FREQUENCY AERIAL FOR CIRCULAR POLARIZATION

This is a continuation of U.S. application Ser. No. 07/839,021, filed Feb. 18, 1992, which is a continuation of prior U.S. application Ser. No. 07/581,501, filed Sep. 11, 1990, both abandoned.

BACKGROUND OF THE INVENTION

The present invention relates to a planar receive and/or transmitting aerial comprising a plurality of radiating plates being dimensioned and adapted to a preferred frequency from a range of possible frequencies, each plate comprising on its periphery four points (N, S, E, O) situated as cardinal points, said circularly polarised waves being equivalent to two linearly polarised orthogonal waves (OH and OV), having the same amplitude, quadrature phase, and whose very high frequency signals are present on each plate whether it is at N and/or S or at E and/or O, said radiating plates being positioned in a parallelogram and either or not being interconnected by a plurality of propagation lines in which said very high frequency signals of said preferred frequency are propagated with a waveguide length equal to "λ".

An aerial of this type is specifically intended for receiving television signals by high-power satellite such as TDF1, TDF2, TVSAT, etc.

An aerial of this type is described in PCT Patent Application No. Wo 89/02662. This prior art aerial comprises propagation lines and has a connecting mode which does not allow of simultaneous reception of clockwise and counterclockwise polarised waves. Furthermore, if one realises a satisfactory gain one will encounter difficulties in implementing propagation lines and output connections.

SUMMARY OF THE INVENTION

It is an object of the present invention to obviate these drawbacks.

An aerial according to the present invention is particularly characterised int hat said plurality of lines comprises:

- a first set of horizontal lines connecting each of the points E and O situated opposite one another, each line having a length equal to $\lambda/2+i\lambda$ with $i=0, 1, 2, \ldots,$
- a second set of vertical lines connecting each of the points N and S situated opposite on another, each line having a length equal to $\lambda/2+j\lambda$ with $j=0, 1, 2, \ldots,$
- a third set of lines realising a serial connection of the points O (or E) situated on the same side of the parallelogram, each line having a length equal to (or equivalent to) $\lambda+k\lambda$ with $k=0, 1, 2, \ldots,$ for summing at a single point H the energy added by the first set of lines, point H being situated in the neighbourhood of one of the corners of the parallelogram,
- a fourth set of lines realising a serial connection of the points N (or S) situated on the same side of the parallelogram, each line having a length equal to (or equivalent to) $\lambda+l\lambda$ with $l=0, 1, 2, \ldots,$ for summing at a single point V the energy added by said second set of lines. said point V being chosen in the neighbourhood of the same corner of the parallelogram as said point H.
- and a single line connecting said two points H and V and passing through two connection points D and G situated such that: $\overline{GH}-\overline{GV}=\lambda/4+m\lambda/2=\overline{DV}-\overline{DH}$ with $m=0, 1, 2, \ldots,$ so that the signal having a clockwise circularly polarised wave is completely present at point D, and the signal having a counterclockwise circularly polarised wave is completely present at point G.

Thus, with a judicious selection of the propagation lines and their lengths, a planar aerial which is particularly simple to realise is obtained. There is not restriction as to the form of the lines, the plates and the parallelogram.

Preferably, a planar antenna is such that:

- said parallelogram is a square comprising 4 radiating plates,
- each plate is a square arranged such that its sides run parallel with those of the parallelogram,
- the lines of said first and second sets are straight lines $\lambda/2$ ($i=j=$"0") in length,
- other said propagation lines have lengths such that: $k=l=m=$"0", for constituting an elementary radiating cell usable for a clockwise and/or counterclockwise circularly polarised wave(s) according to whether the connection point(s) D and/or G is (are) connected or not.

An elementary radiation ell of this type constitutes a preferred embodiment taking into account the minimum surface it uses for a maximum gain.

In order to augment the gain the aerial advantageously comprises a group of two said elementary radiating cells used for one and the same circular polarisation, the two radiating cells being geometrically turned through 90° with respect to one another and physically arranged such that their connecting points are opposite one another for connection to a common output formed by two propagation lines which difference $\lambda/4$ in length.

Thus, the gain is augmented and the polarisation purity improved.

In order to further augment the gain, an aerial comprises a sub-set constituted by two said groups geometrically turned through 180° and whose two common outputs are connected each by a propagation line $\lambda/2$ in length to a single access.

Because of this disposition, the crossed component of the radiating plates is attenuated considerably.

Finally, it is also possible to realise an aerial which comprises a set of four sub-sets supplied in pairs in phase opposition.

Thus, the radiation of the propagation lines is attenuated which still augments the gain until an aerial is obtained that has dimensions such that it can be marketed to the public at large.

In effect, a planar aerial of this type is advantageously realised in microstrip line technology and has three layers, that is to say:

- a conducting layer constituting the radiating surface deposited either by means of copperstrip etching or by means of screen printing with conducting ink,
- a dielectric substrate layer of which the thickness relates to the selected frequency band,
- a ground plane of which the thickness is sufficient to ensure for mechanical rigidity and the mounting of the aerial.

BRIEF DESCRIPTION OF THE DRAWINGS

The present invention will be made easier to understand with the aid of non-limiting embodiments, illustrated by means of the following drawing figures, of which.

DESCRIPTION OF THE PREFERRED EMBODIMENTS

All the Figures to be described hereinafter represent only the plane of the radiating surface and propagation lines of the conducting layer; the other layers and the connection technique with respect to the processing modules of the signal are standard; it should only be observed that the adaptation of the dimensions of the plates and the lengths of the propagation lines depends on the electrical characteristic features of the various layers, more specifically, the dielectric layer; constant dielectric, loss tangent, . . .

Consequently, the length of the waveguide in the microstrip line, to be termed "λ" in the sequel, cannot be directly denoted as a function of the wavelength in the air of the preferred frequency.

In all these drawing Figures the elements having the same function are referenced identically.

Figure 1:
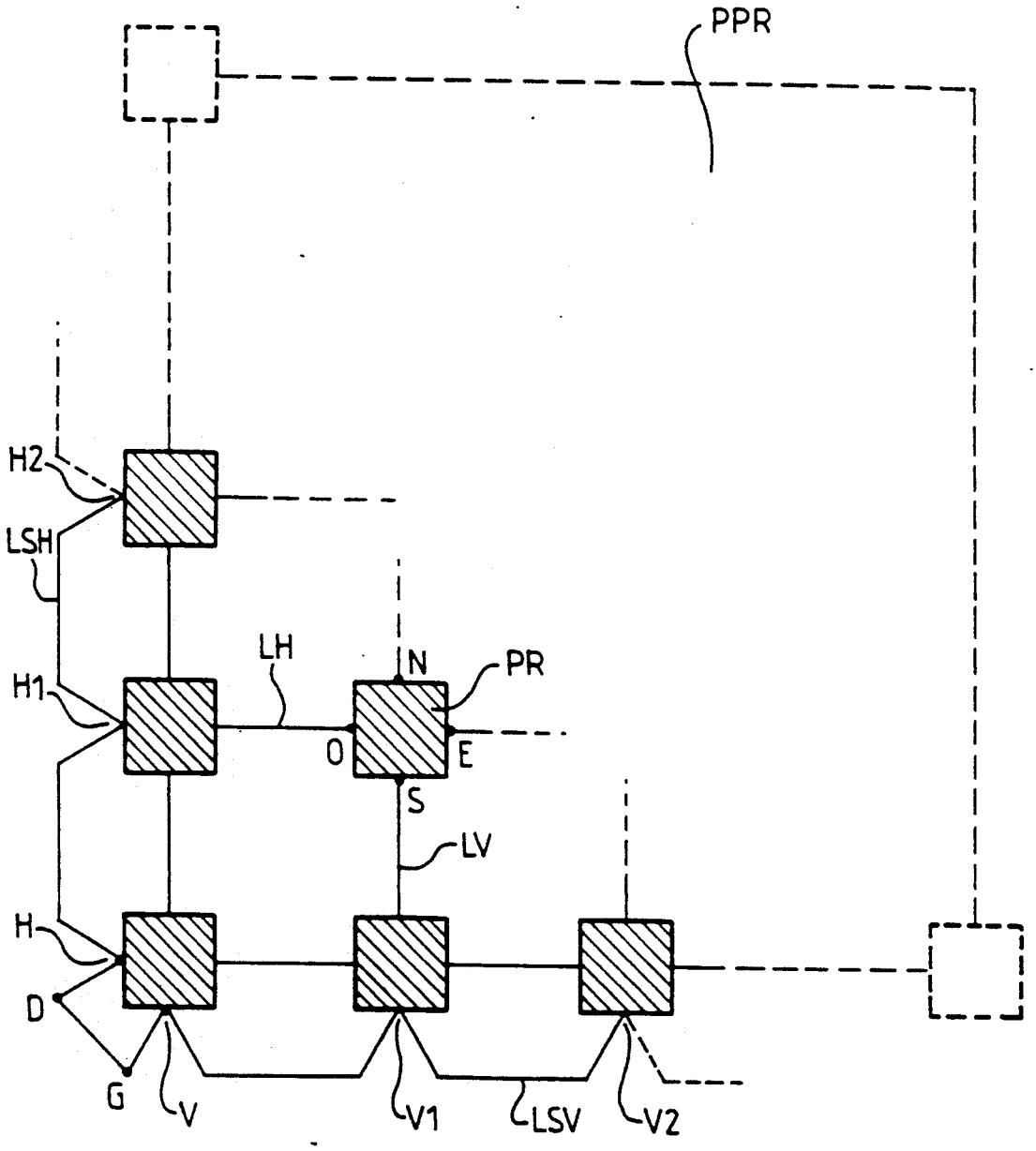
FIG. 1 represents an aerial according to the invention.

In FIG. 1 a parallelogram (PPR) formed by radiating plates (PR) is represented in a dashed line; the plates are connected by propagation lines LV, LH, . . . , which constitutes an aerial of undetermined dimension; the parallelogram is not of necessity rectangular and its sides may show inequality as regards the number of plates and the dimensions of the lines; the lines themselves are not of necessity straight lines.

This general aerial is intended to receive (and/or transmit) high-frequency circularly polarised waves. A circularly polarised wave is equivalent to two linearly polarised orthogonal waves.

Each plate (PR) comprises 4 cardinal points (N, S, E, O) where these different waves appear.

With a first set of horizontal line (LH) the points E and O opposite each other on two adjacent plates are connected and a signal is then present at the end of each line, for example, at the points H1, H2, . . . For these signals to be in-phase it is indispensible that each line (LH) has a length between two plates which is equal to $\lambda/2+i\lambda$ with $i=0, 1, 2, \ldots$ The choice of "i" and the possible sinuosity of the lines (LH) determines the dimension of the parallelogram.

In a similar manner, with a second set of vertical lines (LB), the points N and S opposite one another on two adjacent plates are connected and signal is then present at the end of each line, for example, at the points V1 and V2, . . . Each line (LV) has a length equal to $\lambda/2+j\lambda$ with $j=0, 1, 2, \ldots$; "j" is not of necessity equal to "i".

With a third set of broken lines LSH, the points H1, H2, . . . are connected to each other in series; in FIG. 1 the points H1, H2 . . . are situated at the same spot as the points 0 of the plates situated on the side of the parallelogram. Each line LSH has a length equal to $\lambda+k\lambda$ with $k=0, 1, 2, \ldots$ An object of these lines LSH is to collect the signals present at the ends of lines LH at a single point, point H in FIG. 1.

Similarly, with a fourth set of broken lines LSV, the signals present at the ends of lines LV are collected at point V. Each line LSV has a length equal to $\lambda+l\lambda$, with $l=0, 1, 2, \ldots$ The points H and V are advantageously selected in the same corner of the parallelogram so that a single line (HDGV) connects them passing through two connection points D and G situated such that:

$$\overline{GH}-\overline{GV}=\lambda/4+m\,\lambda/2=\overline{DV}-\overline{DH} \text{ with } m=0, 1, 2, \ldots$$

Thus, at the receive end, a clockwise circularly polarised wave is present at point D and a counterclockwise circularly polarised wave is present at point G. The connection between the standard signal processor modules is realised between the ground plane and either point D or point G or the two simultaneously. It is clearly the same as the transmission of clockwise or counterclockwise polarised waves, or both. In all these cases the connection is permanent and does not require to be modified or even momentarily cut off.

FIGS. 1*a*, 2*b*, 2*c*, 2*d* represent variants of the aerial of FIG. 1. For simplicity of the representation, each variant comprises only four radiating plates and the propagation lines are represented while assuming minimum values, that is to say: $i=j=k=l=m=0$, but these values are clearly not restrictive.

Figure 2A:
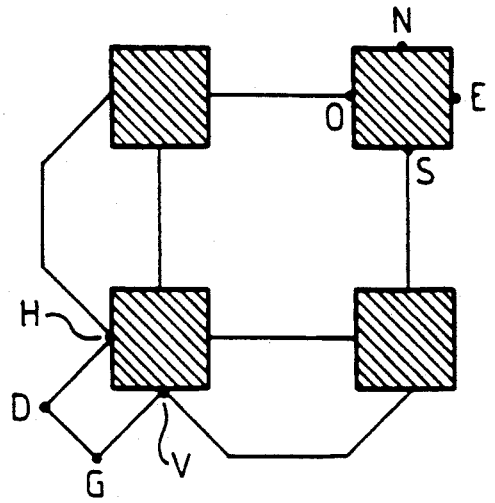
FIGS. 2*a*, 2*b*, 2*c*, 2*d* represent variants of the aerial comprising 4 radiating plates.

FIG. 2*a* is practically similar to FIG. 1 with only four plates.

Figure 2B:
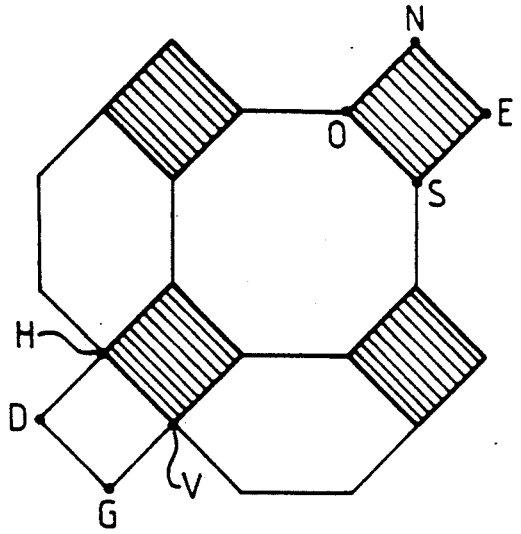

FIG. 2*b* is only different as to the location of the square plates. Therefore points N, S, E, O are no longer found in the middle of the sides but in the corners, however, in all these cases points N, S, E, O are situated on the periphery as are the cardinal points.

Figure 2C:
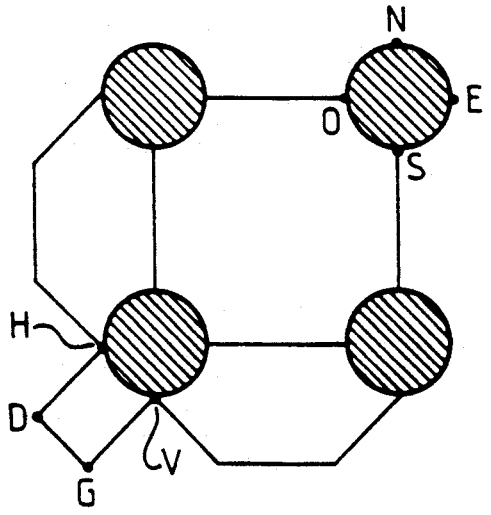

In FIG. 2*c* the radiating plates are round and the rest is unchanged.

Figure 2D:
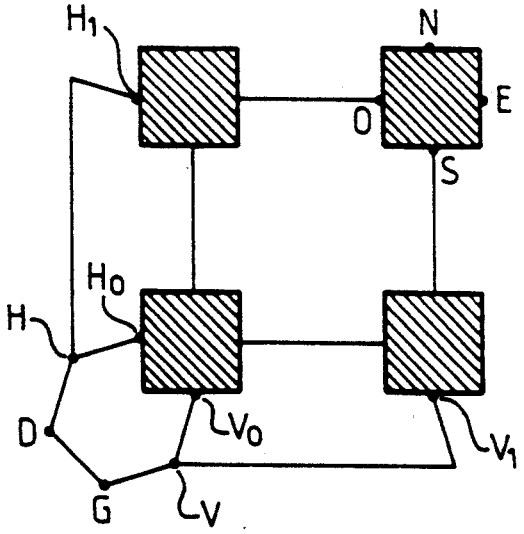

In FIG. 2*d* a variant with respect to FIG. 2*a* of the lines LSH and LSV is introduced and, therefore, the points H and V are no longer confused with the points O and S of the corner plate; this location may be advantageous for "aering" the etching of the propagation lines. It will be evident that, in order to adhere to the lines of the third and fourth sets, the following is to hold here: $\overline{HH}_1-\overline{HH}_0=\lambda=\overline{VV}_1-\overline{VV}_0$, etc. . . .

The aerial represented in FIG. 2*a* forms a preferred embodiment on the basis of which the aerials of the following Figures are realised but this does not form any constraint, aerial 2*a* is termed elementary radiating cell.

Figure 3:
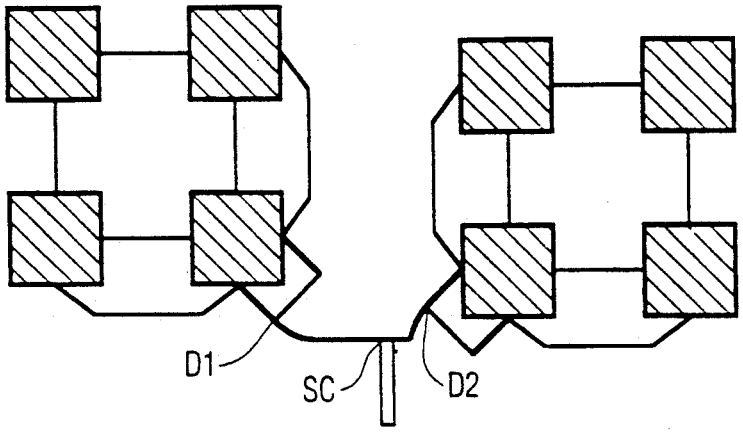
FIG. 3 represents an aerial having 8 plates for clockwise polarisation.

The aerial of FIG. 3 comprises two elementary radiating cells for augmenting the gain and the radiating surface. The respective connection points D1 and D2 are connected to a common output SC by means of propagation lines having lengths such that:

$$\overline{SC/D1}-\overline{SC/D2}=\lambda/4$$

to take into account that the two cells are geometrically turned through 90° with respect to one another. In effect, it is advantageous to locate the two elementary radiating cells such that the points D1 and D2 are closest together in order to avoid too long propagation lines and to improve the purity of polarisation at the single output SC.

Figure 4:
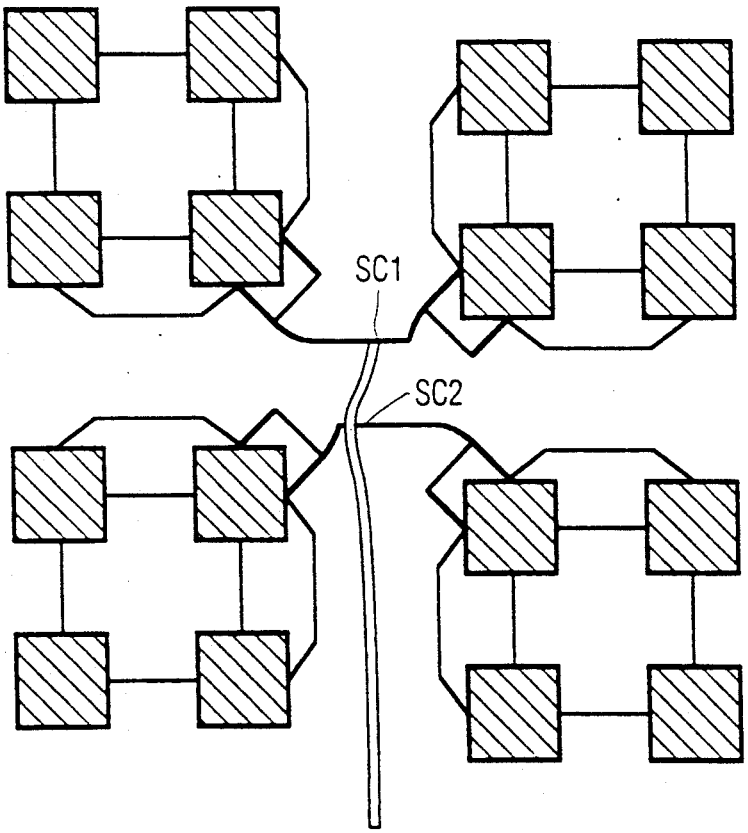
FIG. 4 represents an aerial having 16 plates for clockwise polarisation.

The aerial of FIG. 4 comprises two groups so that the one of FIG. 3, geometrically turned through 180° and whose common outputs SC1 and SC2 are connected by means of a propagation line $\lambda/2$ in length, has only a single access, in this case SC2 as is represented. This arrangement of the aerial makes it possible to attenuate the crossed component of radiation plates while augmenting the gain.

Figure 5:
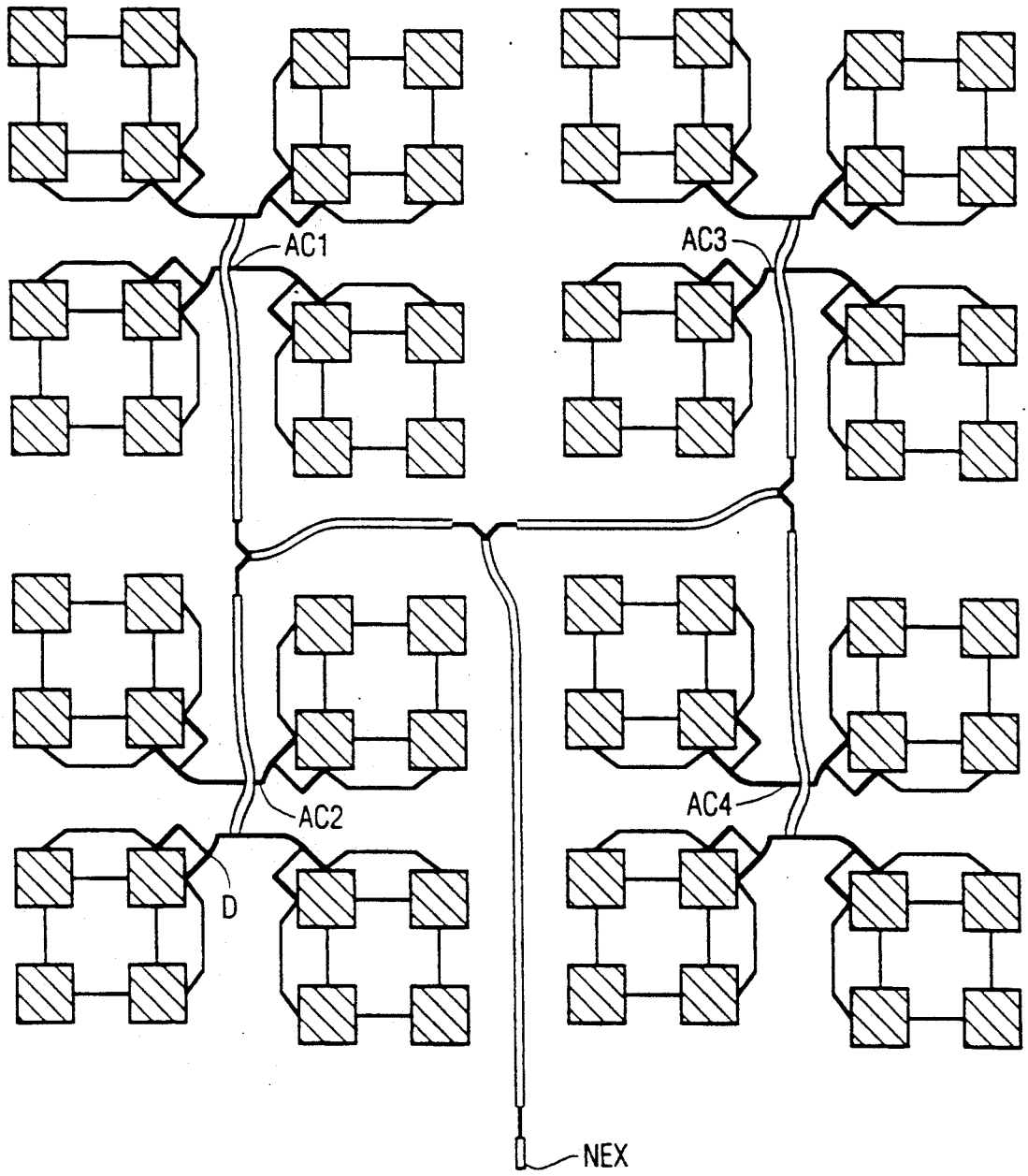
FIG. 5 represents an aerial having 64 plates for clockwise polarisation.

The aerial of FIG. 5 comprises 4 sub-sets, as the ones in FIG. 4, whose respective single accesses AC1, AC2, AC3, AC4 are supplied in pairs in phase opposition by means of propagation lines arranged for realising the connection of the aerial by means of a point NEX.

The aerial of FIG. 5 is suitable for a clockwise polarised wave since each elementary radiating cell is connected by means of its point D.

Figure 6:
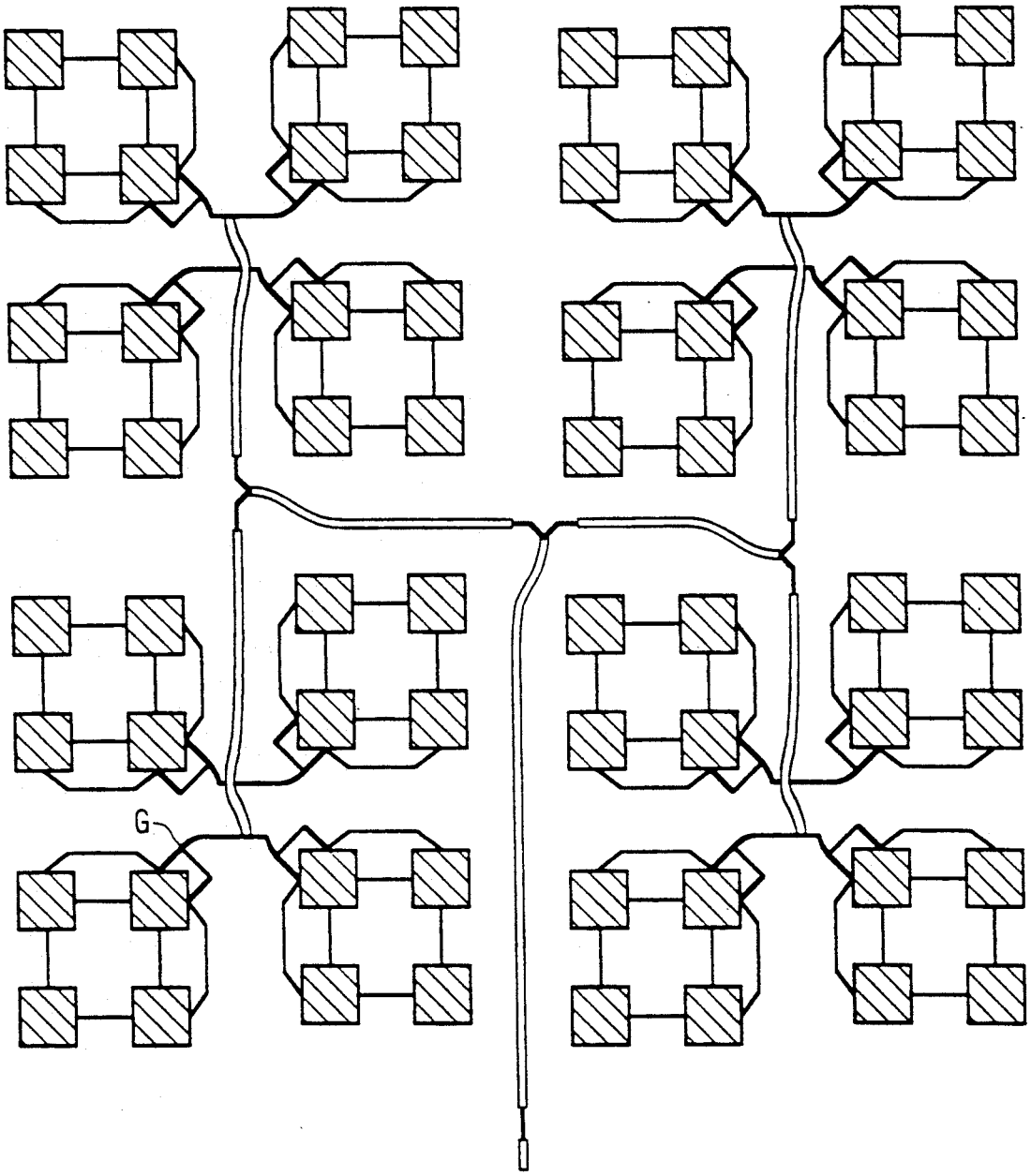
FIG. 6 represents an aerial having 64 plates for counterclockwise polarisation.

The aerial of FIG. 6 is completely equal thereto but this time suitable for a counterclockwise polarised wave because only the points G are connected.

Figure 7:
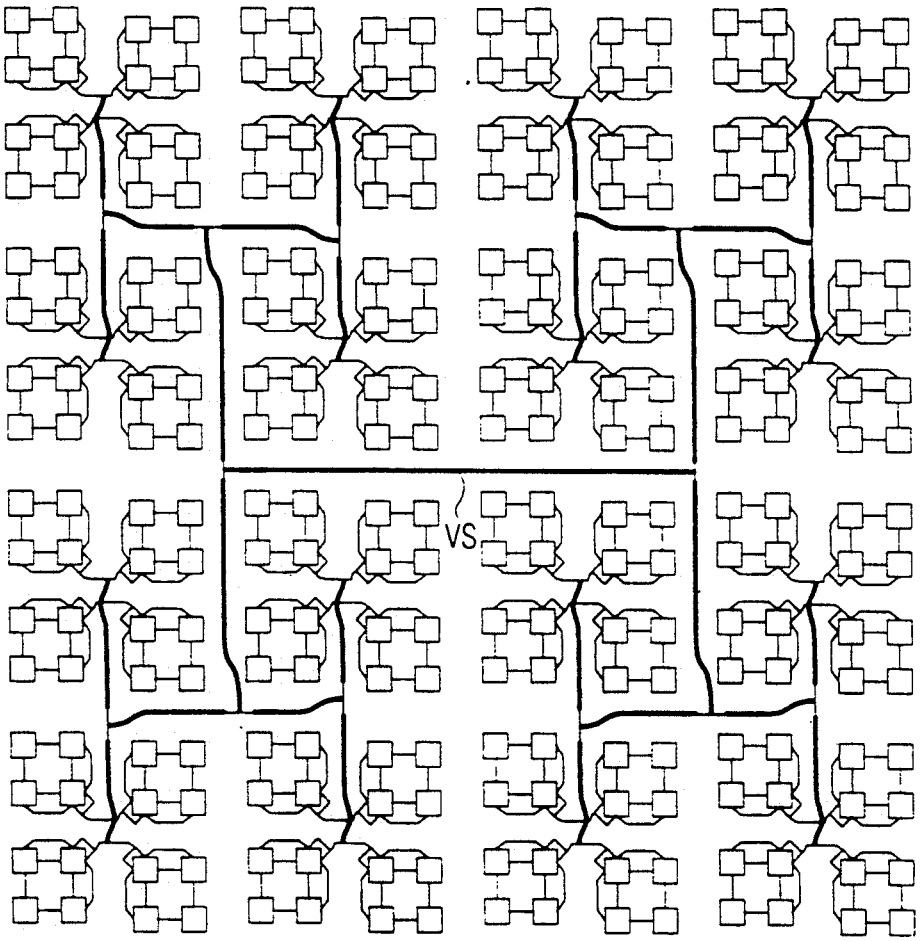
FIGS. 7 and 8 represent an aerial having 256 plates.

The aerial of FIG. 7 comprises four elements as represented in FIG. 5, the single output (US) is found in the centre of the aerial.

Figure 8:
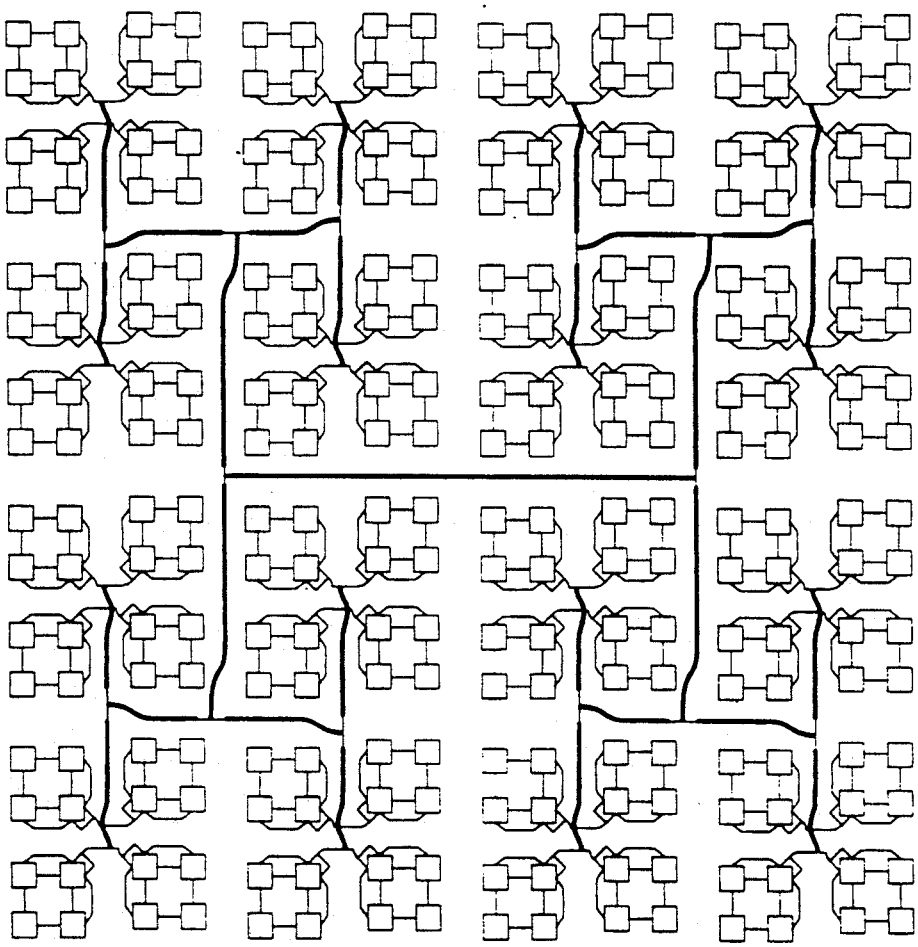

The aerial of FIG. 8 has a similar structure based on that of FIG. 6.

As has been shown, the aerials 7 and 8 comprise $16\times16=256$ radiating plates connected to the output (US) by the propagation lines described hereinbefore.

By way of a non-limiting digital example tests have shown that the aerial 7 is suitable for the satellite TDF1; this satellite transmits at the frequency of 12 GH which corresponds to a wavelength in the air of 25 mm; with an aerial of which the substrate has a thickness of 1.6 mm and a dielectric constant relative to the air of 2.2, the propagation lines are dimensioned for a waveguide length "$\lambda$" of the order of 19 mm and the square plates have sides of approximately 8 mm; the result is a square planar aerial having sides of approximately 300 mm.

The picture quality obtained with an aerial is often estimated digitally by means of the C/N (carrier/noise) ratio measured at the output of the frequency converter associated to the aerial, said aerial being pointed at best toward the satellite TDF1, that is to say, facing it and being associated to a frequency converter that has a 1.6 dB noise factor, a C/N ratio in the neighbourhood of 15 dB may be obtained in the heart of France in bright weather.

I claim:

1. An aerial comprising at least one planar array of conductive plates arranged in the shape of a parallelogram and interconnecting propagation lines arranged and dimensioned for operating at a wavelength $\lambda$, each plate including at its periphery first, second, third and fourth connection points (N, E, S, O) successively disposed at angular intervals of 90°, said lines comprising:

a. a first set of the lines, each connecting the second point (E) of one plate to an adjacent fourth point (O) of another plate and each having a length of $\lambda/2+i\lambda$, where $i=0, 1, 2, \ldots$;

b. a second set of lines, each connecting the first point (N) of one plate to an adjacent third point (S) of another plate and each having a length of $\lambda/2+j\lambda$, where $J=0, 1, 2, \ldots$;

c. a third set of the lines serially connecting ones o the points at a first side of the parallelogram, each of said lines having a length of $\lambda+k\lambda$, where $k=0, 1, 2, \ldots$, for effecting propagation to one of said serially connected points (H), which is disposed proximate a corner of the parallelogram, of signals propagating on the first set of the lines;

d. a fourth set of the liens serially connecting ones of the points at a second side of the parallelogram which is adjacent the first side, each of said lines having a length of $\lambda+l\lambda$, where $l=0, 1, 2, \ldots$, for effecting propagation to one of said serially connected points (V), which is disposed proximate said corner of the parallelogram, of signals propagating on the second set of the lines;

e. a segmented line connecting point H to point V, said segmented line comprising a first segment of length $\overline{DH}$ connecting point (H) to a point (D), a second segment of length $\overline{GV}$ connecting point (V) to a point (G), and a third segment of length $\overline{DG}$ connecting point (D) to point (G), said segments being dimensioned such that $\overline{GH}-\overline{GV}=\lambda/4+m\lambda/2=\overline{DV}-\overline{DH}$, where $m=0, 1, 2, \ldots$, a signal representing a clockwise circularly polarized wave incident to the aerial being produced at point (D) and a signal representing a counterclockwise circularly polarized wave incident to the aerial being produced at point (G).

2. An aerial as in claim 1 where the at least one array comprises four square plates arranged such that their sides define a square shaped array, where the lines of said first and second sets are straight lines, and were $i=j=k=l=m=0$.

3. An aerial as in claim 2 where the at least one planar array comprises at least one group of two arrays of conductive plates, said arrays being turned through 90° relative to each other and situated such that common points of their respective segmented lines are connected to a common output (SC) by respective propagation lines which differ in length by $\lambda/4$.

4. An aerial as in claim 3 where the at least one group of arrays comprises at least one subset of arrays comprising at least two groups of arrays, each of said groups being turned through 180° relative to each other such that their respective common outputs are connected by a propagation line of length $\lambda/2$.

5. An aerial as in claim 4 where the at least one subset comprises at least one set of arrays comprising at least four subsets of arrays each of said subsets having the propagation line of length $\lambda/2$ connected to a common output of the aerial.

6. An aerial as in claim 5 where the at least one set of arrays comprises four set of arrays.

* * * * *